US007540088B2

(12) United States Patent
Takeshita

(10) Patent No.: US 7,540,088 B2
(45) Date of Patent: Jun. 2, 2009

(54) SAFETY RAZOR SHAVING FACE, ARMS AND LEGS

(75) Inventor: Takahiro Takeshita, Seki (JP)

(73) Assignee: Kai R & D Center Co., Ltd., Gifu (JP)

( * ) Notice: Subject to any disclaimer, the term of this patent is extended or adjusted under 35 U.S.C. 154(b) by 78 days.

(21) Appl. No.: 11/342,920

(22) Filed: Jan. 30, 2006

(65) Prior Publication Data

US 2006/0288595 A1 Dec. 28, 2006

(30) Foreign Application Priority Data

Jan. 31, 2005 (JP) ..... 2005-022661

(51) Int. Cl.
*B26B 19/42* (2006.01)
*B26B 21/14* (2006.01)

(52) U.S. Cl. ..... 30/34.2; 30/77; 30/527; 30/537

(58) Field of Classification Search ..... 30/527, 30/537, 34.2, 77, 538
See application file for complete search history.

(56) References Cited

U.S. PATENT DOCUMENTS 1,741,891 A * 12/1929 Vallon ..... 30/537
2,198,531 A * 4/1940 Fulenwider ..... 30/34.2
2,600,880 A * 6/1952 Karle ..... 30/537
2,677,883 A * 5/1954 Schallgruber ..... 30/41
2,726,443 A * 12/1955 Miller ..... 30/34.2
3,517,442 A * 6/1970 Regan ..... 30/41
3,895,437 A * 7/1975 DiBuono ..... 30/537
4,625,402 A * 12/1986 Kavoussi ..... 30/41
4,845,846 A * 7/1989 Sinka ..... 30/34.2
4,944,090 A * 7/1990 Sumnall ..... 30/41
6,655,028 B2 * 12/2003 Coffin ..... 30/41
2002/0157255 A1 * 10/2002 Coffin ..... 30/41

FOREIGN PATENT DOCUMENTS

JP 58-51897 11/1983

* cited by examiner

*Primary Examiner*—Maurina Rachuba
(74) *Attorney, Agent, or Firm*—Jordan and Hamburg LLP

(57) ABSTRACT

A safety razor includes a handle and a razor blade unit on top thereof, wherein the razor blade unit has a movable skin contact member, the skin contact member having a leading skin contact part and a trailing skin contact part, and during safety razor use, the leading skin contact part and trailing skin contact part can swing to the front and back with respect to the razor blade body, thereby enabling smooth shaving, whether for a safety razor having no guard part or for a safety razor having a guard part similar to standard safety razors.

5 Claims, 10 Drawing Sheets

SAFETY RAZOR SHAVING FACE, ARMS AND LEGS

BACKGROUND OF THE INVENTION

The present invention relates to a safety razor; more specifically, it relates to a safety razor developed mainly for women, and suitable for shaving the face, legs and arms.

Conventionally, there have been safety razors wherein a skin contact member is movably mounted on a razor blade unit (see, for example, Laid-open Japanese Utility Model No. S58-51897).

The present invention aims to allow smooth shaving of hair, especially on legs and arms. Further, it aims to lessen the fear felt by women using a razor of a sharp razor blade being in contact with the skin. The aforesaid Japanese Publication S58-51897 describes a safety razor wherein a guard member that is one type of a skin contact member is movable with respect to a razor blade unit. Standard safety razors have a guard part fixed thereto. The safety razor of S58-51897 allows incremental change in guard member movement using an engagement unit, and prior to use, the guard member is fixed in advance at a desired position. Therefore, the guard member does not automatically move during use, and is continuously used at the position once set.

Further, the safety razor described in S58-51897 is for facial hair shaving. Conventional safety razors, including this safety razor, comprise a guard part in front of a cutting edge, and the shaving angle for shaving facial hair is determined by this guard part. The shaving angle is an angle formed by a tangent drawn from the cutting edge to the guard part surface and the razor blade body surface. While the guard part of S58-51897 is movable, it is fixed during use, and performs the same function as a guard part of a conventional razor with a fixed guard part. In recent years, such safety razors have come to comprise, on a guard part, a shaving aid for improving sliding on the skin during use. A guard part of a conventional safety razor is formed to be thin and narrow. The reason for this is that if a guard part is formed thick and wide, when the skin comes in contact with the portion near the front edge of the guard part, with a wide guard part, the portion near the front edge will get in the way, preventing the cutting edge from reaching the skin. Therefore, conventionally, a guard part has not been wide. Because a shaving aid is formed on a narrow guard part, only a small amount of shaving aid is melted and supplied onto the skin. When shaving facial hair, only a portion of the face is shaved, a relatively small amount of supply is sufficient.

SUMMARY OF THE INVENTION

However, when wide sections of the skin, such as on legs and arms, are shaved, sufficient smoothness cannot be achieved with such a small supply. Therefore, it is an object of the present invention, regardless of whether a safety razor comprises a conventional guard part, to provide a skin contact member configured differently from a conventional guard part, that during use supplies a shaving aid in sufficient volume, thereby enabling smooth shaving of legs and arms.

In addition, there are some users who are afraid of a razor blade having a cutting edge extending forward, as a sharp cutting edge is exposed. A safety razor is configured so as to lessen such fear and to be used in safety, and it has conventionally been the guard part provided in a safety razor that plays such a role. Still, some women feel fear shaving legs and arms. Therefore, it is an object of the present invention, in cases where a safety razor does not comprise a guard part and even more so in cases where a safety razor does comprise a guard part, to provide a skin contact member and thereby alleviate fear.

An explanation will be given for the constitution of the present invention. It is a safety razor comprising a razor blade unit at the top of a handle, comprising a skin contact member movable with respect to the razor blade unit, wherein the razor blade unit comprises a razor blade body extending in the longitudinal direction, the skin contact member comprises a leading skin contact part extending in front of and parallel to the razor blade body, and the skin contact member is mounted on the handle or razor blade unit so that, during safety razor use, the leading skin contact part can swing in front of and with respect to the razor blade body.

There is disclosed a safety razor comprising a razor blade unit at the top of a handle, comprising a skin contact member movable with respect to the razor blade unit, wherein the razor blade unit comprises a razor blade body extending in the longitudinal direction, the skin contact member comprises a trailing skin contact part extending to the rear of and parallel to the razor blade body, and the skin contact member is mounted on the handle or razor blade unit so that, during safety razor use, the trailing skin contact part can swing in back of the razor blade body and with respect to the razor blade body.

There is also disclosed a safety razor comprising a razor blade unit at the top of a handle, comprising a skin contact member movable with respect to the razor blade unit, wherein the razor blade unit comprises a razor blade body extending in the lateral direction, the skin contact member comprises a leading skin contact part extending in front of and parallel to the razor blade body, and a trailing skin contact part extending in back of and parallel to the razor blade body, and the skin contact member is mounted on the handle or razor blade unit so that, during safety razor use, the leading skin contact part and trailing skin contact part can swing respectively in front and in back of the razor blade body and with respect to the razor blade body.

An arrangement is disclosed wherein the razor blade unit is formed separately from a handle, constitutes a replaceable razor blade, and has a connection structure for detachably mounting the replaceable razor blade on the handle, and the skin contact member is mounted on the handle or razor blade unit.

There is provided an arrangement wherein the skin contact member comprises a leading skin contact part and trailing skin contact part integrally connected with each other using connectors, and the leading skin contact part and trailing skin contact part integrally swing.

A constriction is provided wherein the skin contact member comprises a leading skin contact part, trailing skin contact part, and one or more connectors, the foregoing members surrounding the razor blade unit.

A constriction is provided in which the skin contact member swings centered on a swing axis line extending in the razor blade longitudinal direction, thereby causing each skin contact part to swing with respect to the razor blade body.

An arrangement is provided wherein a swing axis line passes through or near the connector center, and the entire skin contact member swings in a seesaw manner centered on the swing axis line.

An arrangement is provided wherein the skin contact member is vertically movable with respect to the razor blade unit, and there are provided means for fixing vertical movement of the skin contact member at the upper end and lower end of the moving range.

An arrangement provides that the skin contact member is mounted on a handle or razor blade unit via a connecting body, the connecting body is vertically movable relative to the razor blade unit and has means for fixing at the upper end and lower end of the moving range, the skin contact member is journal connected to the connecting body so as to swing, and by this connection, the skin contact member can swing and vertically move along with the connecting body.

An arrangement is provided wherein a razor blade unit, connecting body and skin contact member are integrally combined with one another to constitute a replaceable razor blade, and there is provided a connection structure for detachably mounting the replaceable razor blade to a handle.

A constriction is provided wherein an upper surface of the razor blade unit head is formed in an arc-shape, at least one razor blade body is mounted on the head, and if the skin contact member is vertically movable, when the same is positioned at the upper end, during swinging of the skin contact member, the degree of head protection with respect to the common tangent connecting the highest position of the leading skin contact part and the highest position of the trailing skin contact part is −1.2 mm or greater and 1.2 mm or less.

A constriction is disclosed wherein windows are provided on at least one of the surfaces of the leading skin contact part and trailing skin contact part, and a portion of a rotating body mounted inside the skin contact part is exposed from the windows.

A constriction is disclosed wherein there are provided a plurality of windows, and rotating bodies exposed respectively from the windows are integrally connected with one another by a single shaft so as to integrally rotate.

A constriction is disclosed wherein at least one of the leading skin contact part and trailing skin contact part is a cylindrical roller and is rotatably connected to the skin contact member, and the roller surface is formed of a shaving aid.

EFFECTS OF THE INVENTION

There is disclosed a safety razor comprising a handle and a razor blade unit on top thereof, wherein the razor blade unit has a movable skin contact member, the skin contact member has a leading skin contact part, and during safety razor use, the leading skin contact part can swing in front of and with respect to the razor blade body. On a conventional safety razor, a guard part is provided in front of a razor blade body extending downward from the razor blade body. With the present invention, however, even when handle angle with respect to the skin frequently changes during use, a leading skin contact part swings in response to the change, allowing smooth hair shaving without any shaving aid. Further, hair can be smoothly shaved by accurate conformance to unevenness of the skin. Further, because the leading skin contact part can swing in front of the razor blade body, there is no hindrance to a hair cutting action by the razor blade body even when the leading skin contact part is formed wide. Therefore, a wide shaving aid can be formed on the leading skin contact part. With a shaving aid formed wide, shaving aid can be sufficiently supplied even when hair of wide areas such as arms and legs are shaved. Further, because a cutting edge was always exposed, some women would feel fear. With the present invention, because the leading contact part swings in front of the razor blade body, the leading skin contact part often covers the cutting edge front surface, and the cutting edge is not always exposed, thereby alleviating fear of the user.

There is disclosed a safety razor comprising a handle and a razor blade unit on top thereof, wherein the razor blade unit has a movable skin contact member, the skin contact member has a trailing skin contact part, and during safety razor use, the trailing skin contact part can swing in back of the razor blade body with respect to the razor blade body. Therefore, as with claim 1, even when a handle angle with respect to the skin frequently changes during use, the trailing skin contact part swings in response to the change, allowing smooth hair shaving. Further, because the trailing skin contact part can swing in back of the razor blade body, there is no hindrance to a hair cut action by the razor blade body even when the trailing skin contact part is formed wide. Therefore, a wide shaving aid can be formed on the trailing skin contact part. With a shaving aid formed wide, shaving aid can be sufficiently supplied even when hair of large areas such as arms and legs are shaved.

There is disclosed a safety razor comprising a handle and a razor blade unit on top thereof, wherein the razor blade unit has a movable skin contact member, the skin contact member has a leading skin contact part and a trailing skin contact part, and during safety razor use, the leading skin contact part and trailing skin contact part can swing respectively in front and back of the razor blade body with respect to the razor blade body. Therefore, even when handle angle with respect to the skin frequently changes during use, the leading skin contact part and trailing skin contact part swing in response to the change, allowing smooth hair shaving even without a shaving aid. Further, because the leading skin contact part can swing in front of the razor blade body and the trailing skin contact part can swing in back of the razor blade body, there is no hindrance to hair cut action by the razor blade body even when both skin contact parts are formed wide. Therefore, a wide shaving aid can be formed on both skin contact parts. With a shaving aid formed wide, shaving aid can be sufficiently supplied even when hair of wide areas such as arms and legs is shaved. Further, because a cutting edge was always exposed, some women would feel fear. With the present invention, because a leading skin contact part can swing in front of the razor blade body, the leading skin contact part often covers a cutting edge front surface, and the cutting edge is not always exposed, alleviating fear of the user. Further, there are cases where only one of the skin contact parts is brought in contact with the skin during use, and there are cases where both skin contact parts are simultaneously brought in contact with the skin. In these cases, when hair is cut, because skin is supported by the skin contact parts provided in front and back of the razor blade unit, stability is achieved. With the skin contact parts formed wider, much greater stability can be achieved.

There is disclosed a connection structure for detachably mounting a replaceable razor blade on the handle, and with a skin contact member mounted on the handle or razor blade unit. Therefore, with a safety razor configured as a replaceable razor blade type, the effects of claims 1 through 3 can be achieved.

There is disclosed a skin contact member comprises a leading skin contact part and trailing skin contact part integrally connected with each other using connectors, and the leading skin contact part and trailing skin contact part integrally swing. Therefore, because a skin contact member comprising the leading skin contact part and trailing skin contact part can be integrally formed, manufacture thereof is simple, and it is not necessary to mount each skin contact part to a handle or razor blade unit, so that the constitution does not become complicated.

There is disclosed an arrangement wherein a leading skin contact part, trailing skin contact part, and one or more connectors, and the foregoing surround the razor blade unit.

Therefore, because it is sufficient to mount the connectors on the razor blade unit, mounting the skin contact member to a handle is facilitated.

There is disclosed an arrangement wherein the skin contact member swings centered on a swing axis line extending in the razor blade longitudinal direction, thereby causing each skin contact part to swing with respect to the razor blade body. Therefore, when one of the skin contact parts upwardly swings, the other skin contact part swings downwardly in response thereto, thereby allowing both skin contact parts to approach each other, and preventing problems in operations.

There is disclosed an arrangement wherein a swing axis line which passes through the connector center, and the entire skin contact member swings in a seesaw manner centered on a swing axis line. Therefore, because the central axes of the leading skin contact part and trailing skin contact part are spaced substantially equidistant from each other, both skin contact parts are brought in contact with the skin in a balanced manner during use.

There is disclosed an arrangement wherein the skin contact member is vertically movable with respect to the razor blade unit, and there is provided means for fixing vertical movement of the skin contact member at the upper end and lower end of the moving range. Therefore, when the skin contact member is fixed at the lower end, because the razor blade unit protrudes, the skin contact member does not inhibit shaving hair of a recessed portion of the skin. Because the position of the skin contact member can be selected, it can be changed in accordance with shaving area.

There is disclosed an arrangement wherein the skin contact member is mounted on a handle or razor blade unit via a connecting body, the connecting body is vertically movable relative to the razor blade unit and has means for fixing at the upper end and lower end of the moving range, the skin contact member is journal connected to the connecting body so as to swing, and by this connection, the skin contact member can swing and vertically move along with the connecting body. In a case where a skin contact member is directly mounted on a handle or razor blade unit, in addition to a connection device for mounting the same to the skin contact part, a swing device and a device allowing vertical movement need to be provided, resulting in a complicated constitution. With a connecting body, the constitution of the skin contact member becomes simple, therefore facilitating manufacturing thereof.

There is disclosed an arrangement wherein a razor blade unit, connecting body and skin contact member are integrally combined to constitute a replaceable razor blade, and there is provided a connection structure for detachably mounting the replaceable razor blade to a handle. Therefore, when a razor blade cutting has become dull, the razor blade can be replaced with a new one, allowing long use of the handle.

There is disclosed an arrangement wherein an upper surface of the razor blade unit head which is formed in an arc-shape, at least one razor blade body is mounted on the head, and if the skin contact member is vertically movable, when the same is positioned at the upper end, during swinging of the skin contact member, the amount of head projection with respect to the common tangent connecting the highest position of the leading skin contact part and the highest position of the trailing skin contact part is −1.2 mm or greater and 1.2 mm or less. When the degree of head projection is such a value, the head is brought in contact with the skin during use without excessive force. Thus, because the head upper surface is formed in an arc-shape, it smoothly slides on the skin. When a plurality of razor blade bodies are provided on the head, during swinging of the skin contact member, at least one of the cutting edges can be always brought in contact with the skin.

There is disclosed an arrangement wherein windows provided on at least one of the surfaces of the leading skin contact part and trailing skin contact part, and a portion of a rotating body mounted inside the skin contact part is exposed from the windows. During use, because the rotating body exposed from the window rolls on and pressures the skin, a massage effect can be achieved.

There is disclosed an arrangement wherein a plurality of windows, and rotating bodies exposed respectively from the windows are integrally connected with one another by a single shaft so as to integrally rotate. Therefore, because the rotation speed of the rotating bodies is the same, all of the rotating bodies smoothly rotate in the same manner. Therefore, the skin contact part smoothly slides on the skin, and due to a plurality of rotating bodies, massage action can be further improved.

There is disclosed an arrangement wherein at least one of the leading skin contact part and trailing skin contact part is a cylindrical roller and is rotatably connected to the skin contact member, and the roller surface constitutes a shaving aid. The present invention is configured so that the skin contact part swings during use. Therefore, there is no hindrance to the hair cut operation even when the skin contact part is formed wide. Therefore, when hair of wide areas such as arms and legs are shaved by a thick roller, shaving aid can be sufficiently supplied to the skin, thereby allowing smooth operation at all times.

DESCRIPTION OF THE PREFERRED EMBODIMENTS

Figure 8:
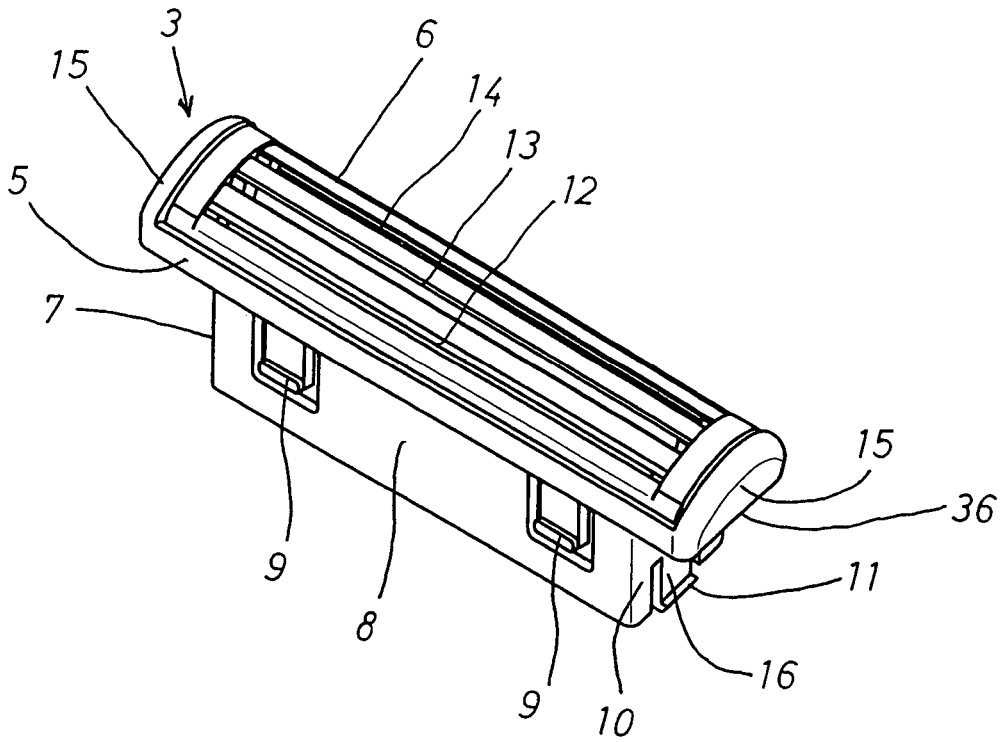
FIG. 8 is a perspective view of a razor blade unit.
Figure 14:
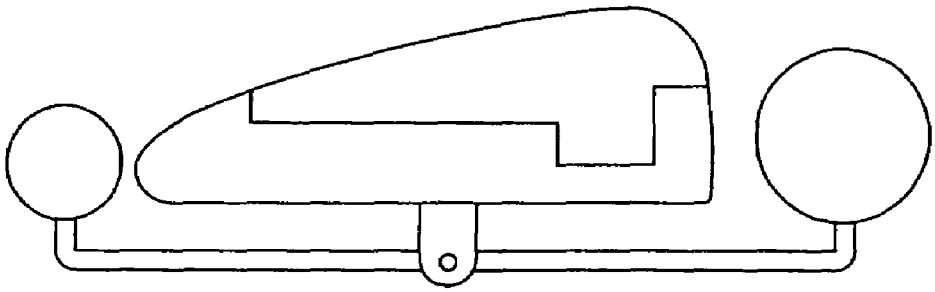
FIG. 14 is a view showing a frame when other razor blade unit is used.

Next, the best mode to carry out the invention will be explained. A safety razor of this configuration is a replaceable razor blade type, wherein a replaceable razor blade 2 can be detachably mounted on a handle 1. The replaceable razor blade 2 comprises a razor blade unit 3 and skin contact member 4. As shown in FIG. 8, the razor blade unit 3 comprises a base 5 therefore and a razor blade cartridge 6 as a separate body. The razor blade cartridge 6 is fitted between both sidewalls 15, 15 of the base, and may be configured so as to be detachable. Therefore, it is sufficient to replace only the razor blade cartridge 6. The razor blade cartridge 6 is configured so that the upper surface is formed in an arc-shape, and three cutting edges 12, 13, 14 are exposed in order from the front side of the razor blade cartridge 6. The rear cutting edge 14 is provided on the rear of the razor blade cartridge top. The middle cutting edge 13 is provided substantially on the top, and it may be provided to the front or rear of the top. Thus, because the cutting edges are not provided on a plane surface, there may be cases where not all of the cutting edges are in contact with the skin during use. The razor blade cartridge 6 constitutes a head of the razor blade unit 3. The present invention is not limited to an arc-shape with respect to the upper surface of the razor blade cartridge 6. For example, like the conventional article shown in FIG. 14, a razor blade unit may be configured such that a razor blade body is placed on a razor blade base, a plate-like top board is placed on the razor blade body, and the razor blade body is sandwiched and fixed between the razor blade base and the top board. The upper surface of such a plate-like top board is formed flat and is not in an arc-shape.

Figure 5:
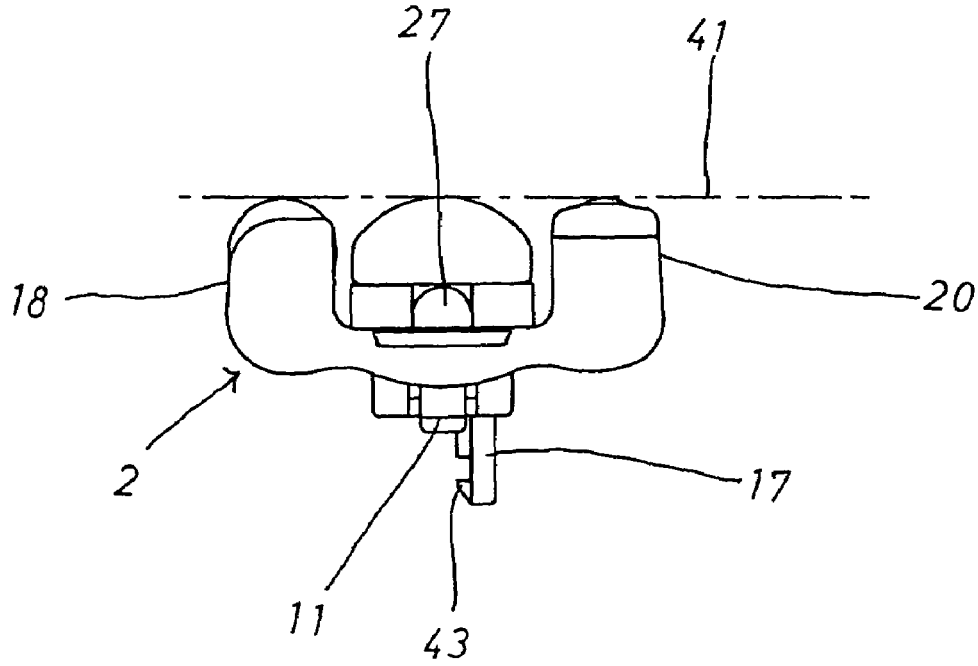
FIG. 5 is a side view of a replaceable razor blade.
Figure 6:
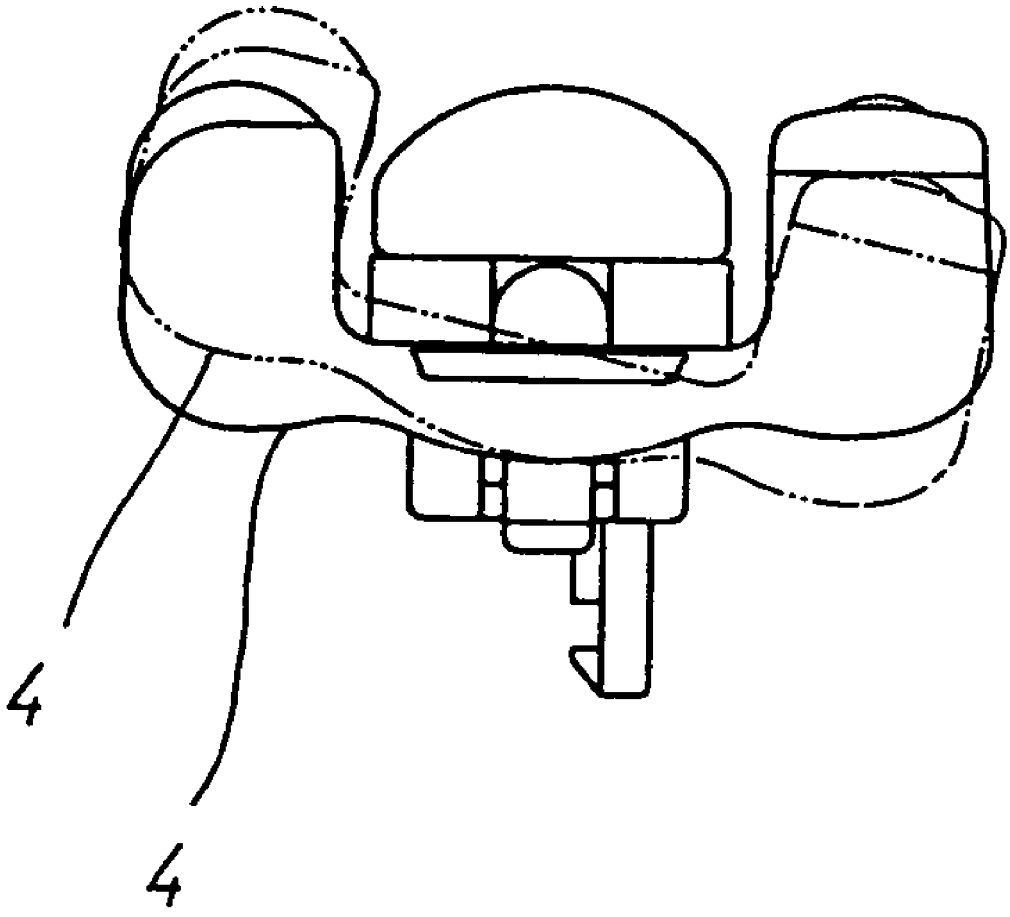
FIG. 6 is a diagram showing a replaceable razor blade skin contact member in a swinging state.
Figure 7:
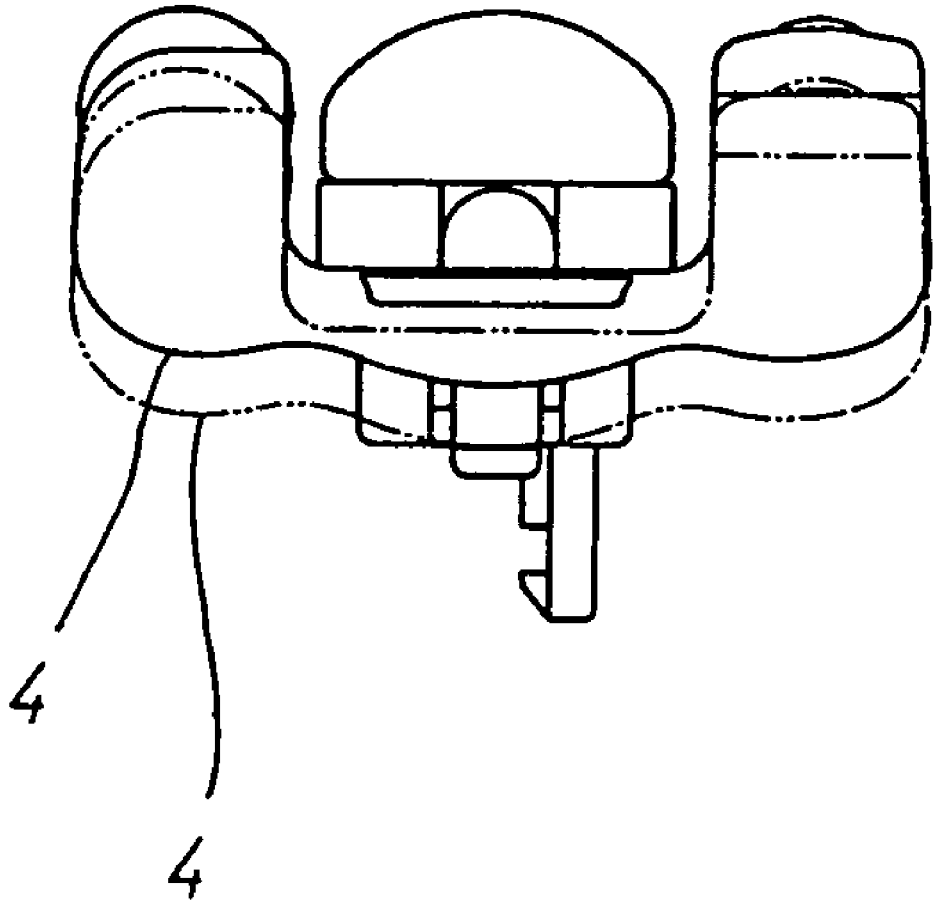
FIG. 7 is a diagram showing a replaceable razor blade skin contact member during vertical movement.

As shown in FIG. 5, the degree of projection of the razor blade cartridge 6, that is, the head, with respect to a common tangent 41 connecting the highest position of a leading skin contact part 18 and the highest position of a trailing skin contact part 20 is −1.2 mm or greater and 1.2 mm or less. As shown in FIG. 6, during swinging of the skin contact member 4 as well, the degree of projection is within this value range. With a configuration such that the upper surface of the razor blade cartridge 6 is formed in an arc-shape, the degree of projection of the razor blade cartridge 6 can be stabilized during swinging.

Figure 1:
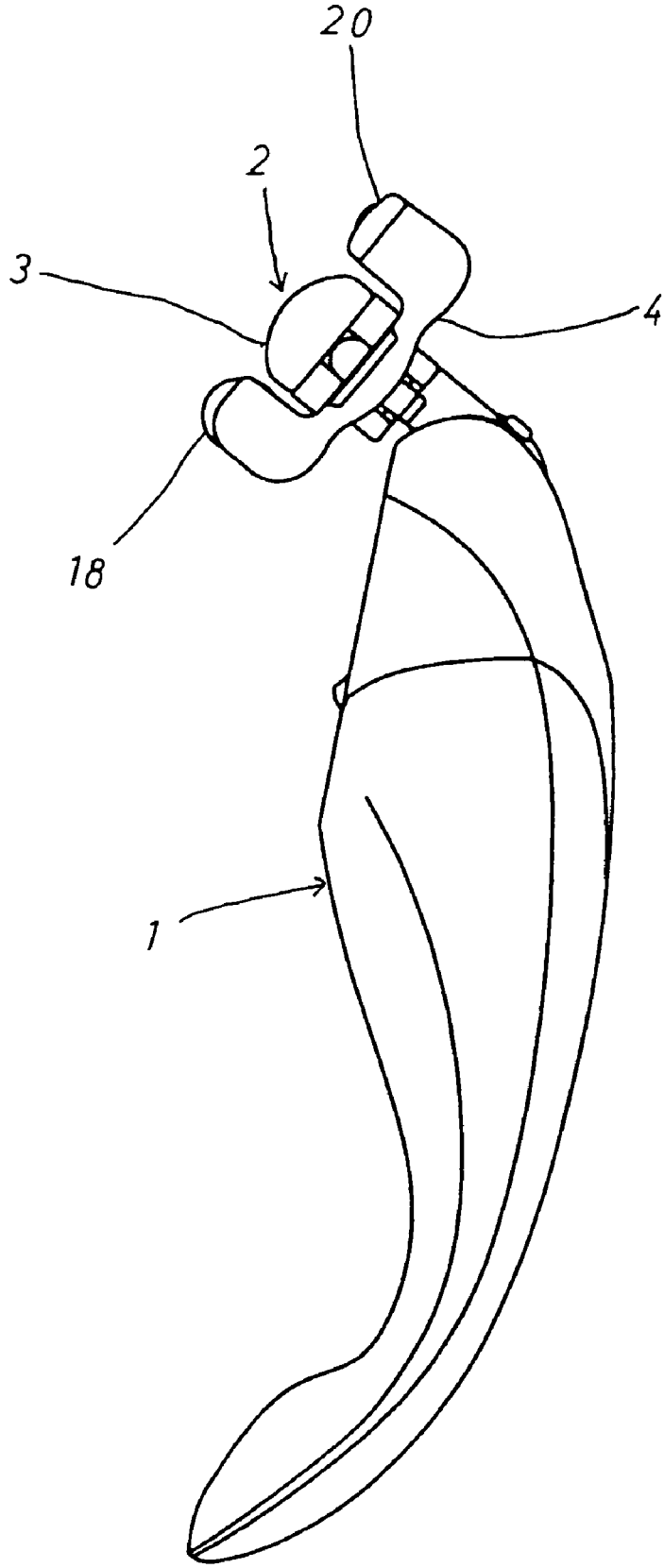
FIG. 1 is a side view of the present invention.
Figure 2:
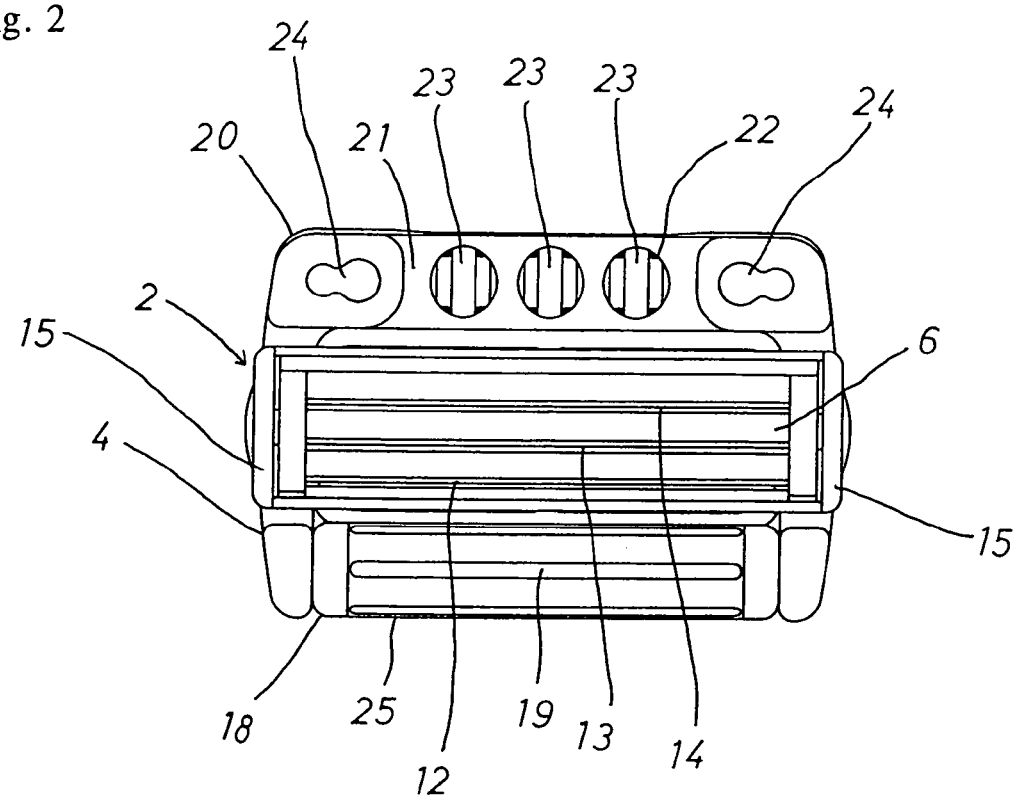
FIG. 2 is a top view of a replaceable razor blade.
Figure 3:
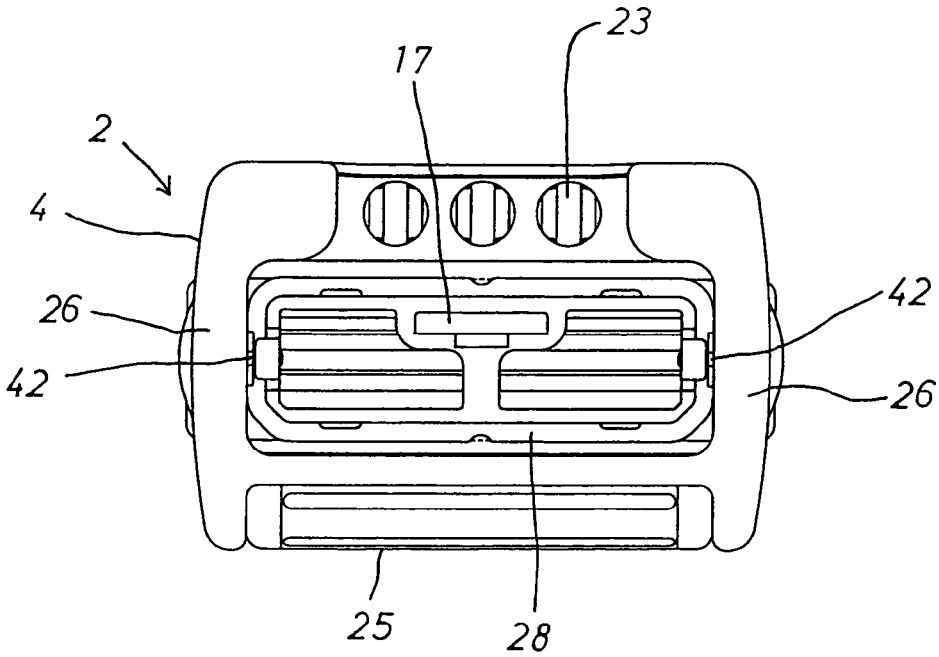
FIG. 3 is a bottom view of a replaceable razor blade.
Figure 4:
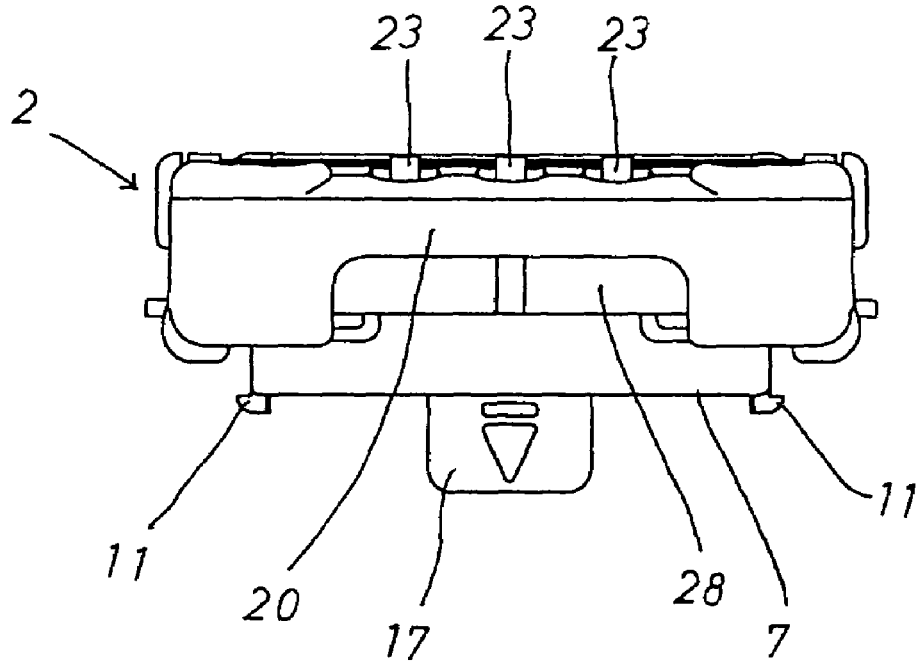
FIG. 4 is a rear view of a replaceable razor blade.

A trunk 7 of the base 5 is formed in a rectangular shape, and there are formed two engagement projections 9, 9 at positions somewhat lower than the middle of both lateral surfaces 8. The engagement projections 9, 9 are formed integral with an elastic piece, and can sink into the lateral surface 8. An engagement projection 11 is formed at a position somewhat lower than the lower end of both end surfaces 10 of the base 5. The engagement projection 11 is formed integral with an elastic piece 16, and can sink in past the end surfaces 10. A connection piece 17 is integrally formed on the bottom of the base 5. The connection piece 17 is inserted in an opening provided on the upper end of the handle 1, and an engagement projection 43 formed on the lower end of the connection piece 17 engages with a connection structure inside the opening to connect a replaceable razor blade 2 to the handle 1. As shown in FIG. 4, the arrow on the engagement [sic] piece 17 indicates the engagement piece 17 insertion direction.

The skin contact member 4 is formed in a rectangular frame shape, and a cylindrical roller 25 is rotatably mounted on the leading skin contact part 18. A shaving aid is formed on the surface of the roller 25. Examples of a shaving aid to be added include a fragrance, toner, emulsion, hemostat, hair growth inhibitor, depilation agent, facial hair softener, plant-based female hormone-like ingredient, water-absorbing heat generating agent and the like. More specifically, vitamin A, vitamin C, hydroquinone, alpha arbutin, collagen, retinoic acid, ceramide, hyaluronic acid, lipidure, amino acid, soy extract (flavosterone), papaya extract (papain enzyme), isoflavone, aloe barbadensis extract, blackberry lily extract, Guttiferae extract, field horsetail extract, lemon extract, seaweed extract, scutellaria extract, sialid extract, clove extract, licorice extract, Japanese pepper extract, Rahmannia Chinese extract, carrot extract, rosemary extract, macrophyllus extract, green tea extract, henna leaves extract, lithospermi radix extract, hop extract, coix extract, rice germ extract and the like may be added at 0.05 to 10 wt. %. Addition thereof provides a skin beautifying effect, moisturizing effect, hair growth inhibition, and hair removal effect. Possible methods for forming the roller 25 on which such a shaving aid is formed include injection molding and extrusion molding. In a case where a hard resin is provided on a core, areas around a core material may be covered with a shaving aid by performing injection molding twice or simultaneous extrusion molding. Further, because a plurality of grooves 19 are formed on a surface of the roller 25 in the longitudinal direction, and rotation of the roller 25 is facilitated during use, the overall shaving aid is uniformly consumed. As an alternative to the grooves 19, ribs may be provided. While the diameter of the cylindrical roller 25 is preferably around 7.5 mm, the present invention is by no means restricted to this value, and the diameter may be 3 mm-4 mm, 4 mm-7.5 mm, or around 7.5 mm-10 mm. Because such a value is considerably larger than that of conventional guard part, a shaving aid can be sufficiently supplied when large areas such as legs and arms are shaved.

As a material for forming the roller 25, metal, hard resin, soft resin such as an elastomer, a rigid porous body such as pumice stone, or a soft porous body such as sponge is used. In a case of a porous body, a solid, semifluid, or liquid shaving aid can be impregnated therein. By having a shaving aid impregnated, the shaving aid is formed on the surface of the roller 25. Such a roller 25 may be provided on the rear of the razor blade unit 3. As an alternative to the roller 25, a non-rotatable flat shaving aid surface may be provided.

The upper surface of the trailing skin contact part 20 is formed on the skin contact surface 21. This skin contact surface 21 is formed as a shallow curved surface having a curvature radius of at least 8 mm. While the curvature radius is preferably between 12 mm and 20 mm, it may be 10 mm, 22 mm, 24 mm or more. Instead of being a curved surface, it may be a flat surface. The width in the front-rear direction of the trailing skin contact part 20 is roughly 7.5 mm. The width in the front-rear direction of the skin contact member 4 is roughly 28.5 mm and the width in the front-rear direction of the razor blade cartridge 6 is roughly 10.5 mm. From the foregoing it will be understood that the width in the front-rear direction of the roller 25 mounted on the above described leading skin contact part 18 and of trailing skin contact part 20 occupy a large proportion of the width in the front-rear direction of the razor blade cartridge 6.

Three windows are provided on the skin contact surface 21, and disk-shaped rollers 23 are exposed respectively from such windows 22. These three disk-like rollers 23 are connected to one another by a single shaft and journal connected under the skin contact surface 21. The material of the disk-like rollers 23 may be, in addition to a hard resin, metal or the like. All of the plurality of disk-like rollers 23 may be formed from the same material, or they may be formed by combining different materials. As an alternative to the disk-like rollers 23, balls may be supported by coil springs or the like and exposed from the windows 22.

The skin contact surface 21 has holes 24, 24 near both ends. Solid soap is accommodated inside the holes 24, 24. The ingredients listed in paragraph 0040 as shaving aid additives may be added to this solid soap. It may be chosen not to provide these disk-like rollers 23 and solid soap, or it may be chosen to provide only one of them. Alternately, other means for ensuring smooth contact with skin during use may be employed.

Ends of the leading skin contact part 18 and trailing skin contact part 20 are integrally connected to each other through connectors 26, 26, and the skin contact member 4 as a whole is formed in a rectangular frame-like shape. The connectors 26 are formed so that the vertical width is narrow, and the leading skin contact part 18 and trailing skin contact part 20 provided on at both ends thereof extend above the connectors 26. Therefore, the skin contact member 4 is formed in a U-shape as shown in FIG. 5. Because it is configured in a U-shape, when the skin contact member 4 swings, a part of the skin contact member 4 is brought in contact with the razor blade unit 3 within the U-shape, thus regulating the swinging to be at a constant angle. As described below, the same applies when the skin contact member 4 moves below the razor blade unit 3. A bearing 27 is integrally provided on the center bottom of the connectors 26, and a journal bearing is formed on the inner surface thereof (not shown in the drawing).

Figure 9:
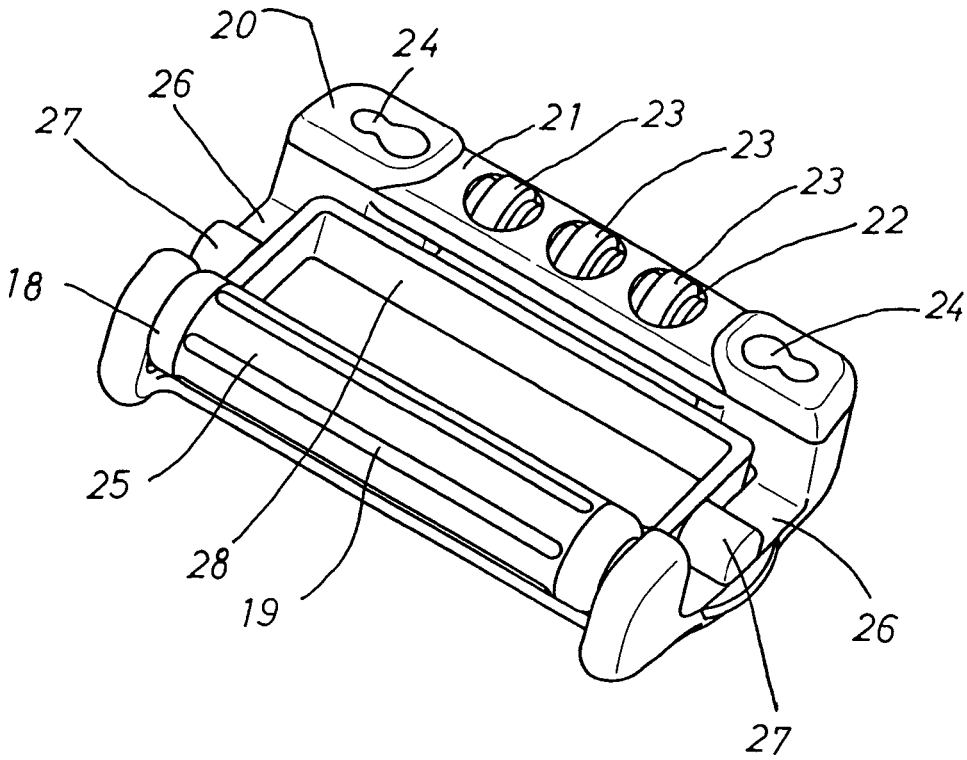
FIG. 9 is a perspective view of a skin contact member and connecting body combined with each other.
Figure 10:
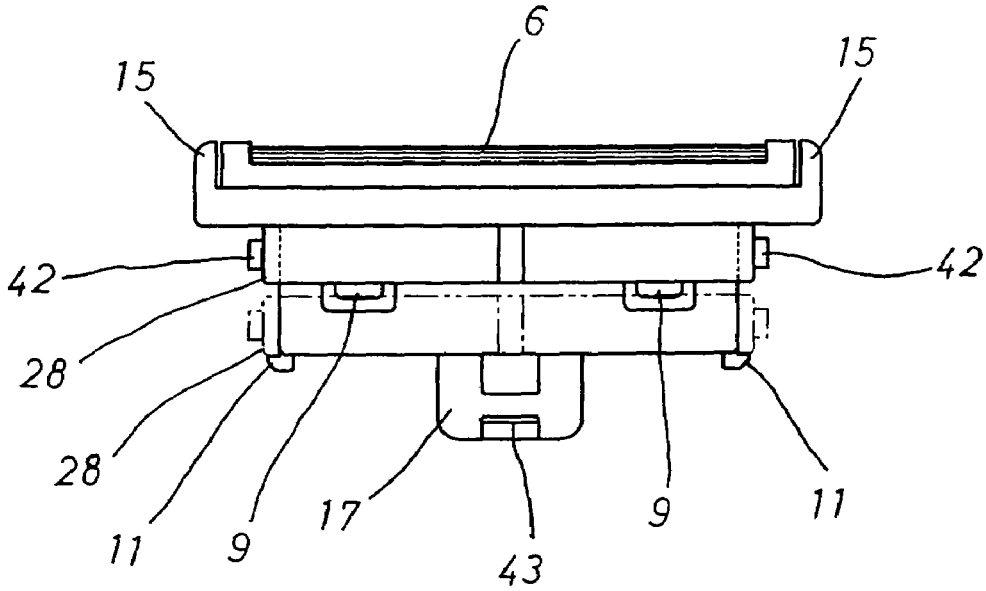
FIG. 10 is a front view of a razor blade unit.

A connecting body 28 for connecting the skin contact member 4 to the razor blade unit 3 is mounted inside the frame of the frame-like skin contact member 4. As shown in FIG. 9 and FIG. 10, the connecting body 28 is formed in a rectangular frame-like shape, journal shafts 42, 42 are provided on the outer surface of both sides of the connecting body 28, and the journal shafts 42, 42 are journal connected with the journal bearing formed on the bearing 27 of the connectors 26, 26. The connecting body 28 swings in a seesaw-like manner centered on the journal axis line by means of the journal connection. The swinging axis line provided lower than the razor blade body.

As shown in FIG. 10, the trunk 7 of the base 5 of the razor blade unit is movably fitted inside the frame of the connecting body 28. The connecting body 28 is vertically movable with respect to the trunk 7, and is fixed within the upper end position and lower end position of the moving range. Fixing means are engagement projections 9, 9 provided on the lateral surfaces 8 of the base 5, and an engagement projection 11 provided on the end surface 10. When the connecting body 28 is at the upper end position, the lower end edge of the connecting body 28 engages with the engagement projections 9, 9, and is fixed at such position without lowering.

When the connecting body 28 is pulled downward to move the connecting body 28 to the lowest end position, the connecting body 28 lowers while pressing the engagement projections 9 into the lateral surface 8. When the connecting body 28 has completely passed over the engagement projections 9, the lower end edge of the connecting body 28 engages with the engagement projection 11. At this time, the upper end edge of the connecting body 28 engages with the engagement projections 9, 9 that have returned to their original positions and is fixed thereby in a manner preventing upward displacement. The skin contact member of the present invention is not limited to a constitution such that it is movable in the vertical direction, and may be constituted so that it is provided so as to be fixed in the vertical direction with respect to the razor blade unit 3. In particular, when the skin contact member 4 is provided so as to be vertically fixed with respect to the razor blade unit 3, by interposing an elastic member therebetween, the skin contact member 4 can be made to elastically swing. Further, when an elastic member is provided in front of and in back of the razor blade unit, the initial position of the skin contact member 4 is level, and when an elastic member is provided on one side, the initial position is a state where the skin contact member 4 has swung toward the other side. As an alternative constitution, the front and rear of the skin contact member 4 are switched so that the above-described configuration of the leading skin contact part 18 serves as the configuration of the trailing skin contact part 20, and the configuration of the trailing skin contact part 20 serves as the configuration of the leading skin contact part 18. The razor blade unit and skin contact member are members directly in contact with the skin. They are preferably configured in a color other than red. This is because before or after using a safety razor, if there is blood on these members, the blood cannot be easily seen if the members are red. Further, these members may be associated with blood if they are red, causing the user to feel fear in combination with fear from the exposed razor blade. For example, if they are white, green, light blue or light pink white, green, light blue or light pink, adhesion of blood can be easily found, and such colors do not cause fear.

Figure 12:
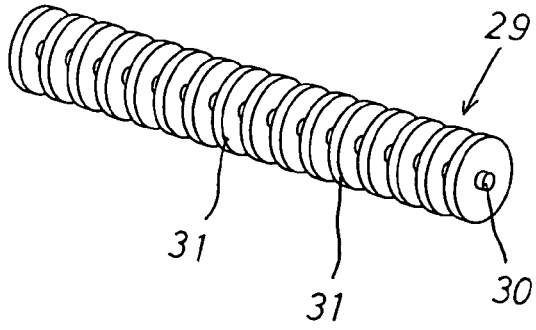
FIG. 12 is a perspective view showing other embodiment of a roller.

A roller 29 as shown in FIG. 12 may be used instead of the above described roller 25. More specifically, the roller 29 is rotatably mounted on the leading skin contact part 18 or trailing skin contact part 20 centering on the shaft 30. The roller 29 has a number of disk-like comb blades 31 around the shaft 30 extending in the longitudinal direction. Massage action is achieved with these comb blades 31 when hair of arms and legs is shaved. Further, when long hair of arms and legs and hair is cut, because the cutting takes places as the comb blades 31 comb the hair, the hair can be cut without unevenness. This roller 29 can be used for a safety razor shown in the drawings, and it may be used for a safety razor in which the roller 29 is fixed so as not to swing with respect to a razor blade body and only rotates. Further, instead of a replaceable razor blade type safety razor, the roller 29 may be used in a safety razor in which a razor blade unit is integrally provided on the handle upper end. The roller 29 is formed mainly from plastic, but may be formed from metal or other material. Further, a shaving aid may be formed on the surface of the roller 29. The interval of comb blades 31 is preferably 1 mm or greater and 10 mm or less, the thickness of the comb blades 31 is preferably 0.5 mm or greater and 5 mm or less, and the diameter of the comb blades 31 is preferably 3 mm or greater and 16 mm or less. It is preferable that the ratio between diameter and thickness of the comb blades be such that the diameter is at least twice as much as the thickness. The interval between comb blades is preferably larger than the thickness of the comb blades The interval between comb blades is preferably larger than the thickness of the comb blades.

Figure 11:
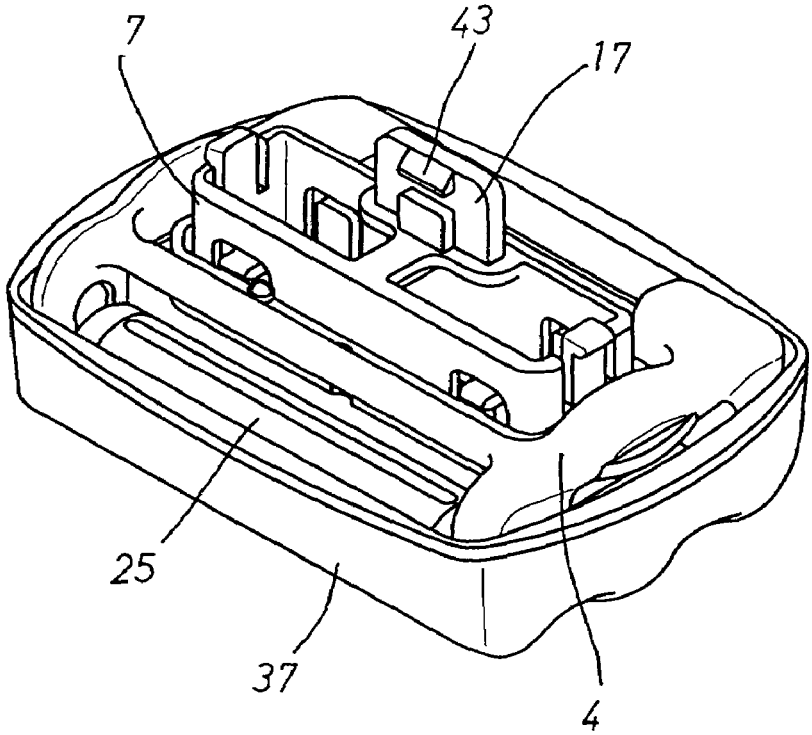
FIG. 11 is a perspective view of a replaceable razor blade having a cap fitted thereon.
Figure 13:
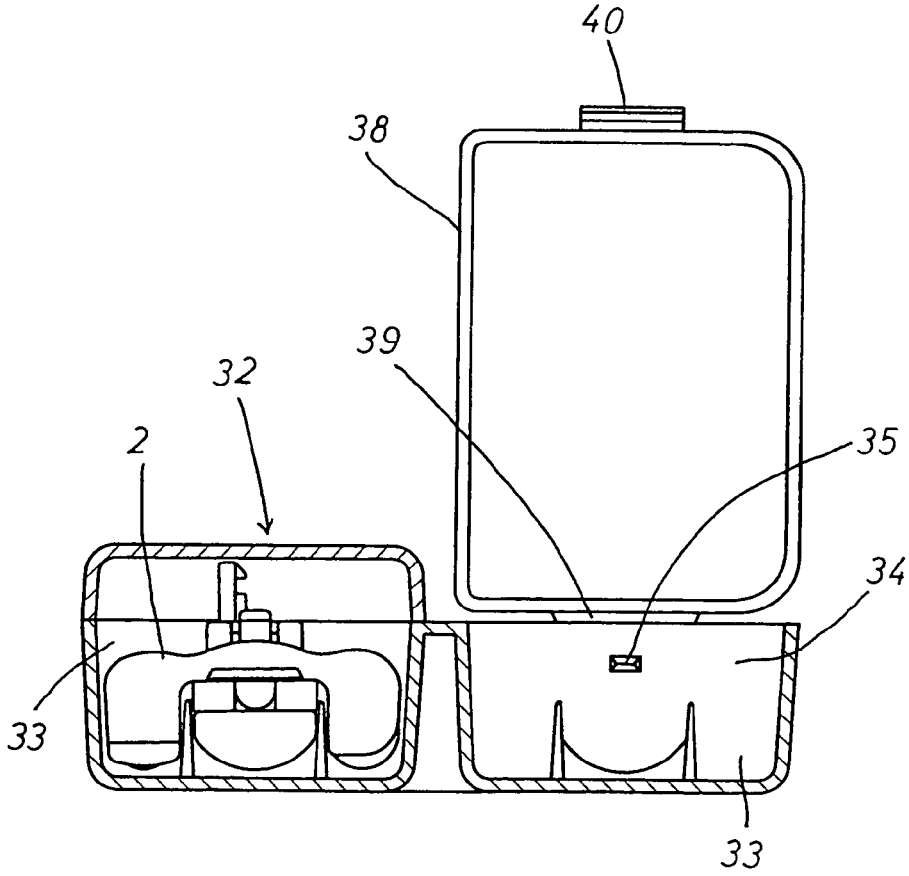
FIG. 13 is a cross-sectional view of a replaceable razor blade case.

As shown in FIG. 13, the replaceable razor blade 2 can be accommodated in a case 32. The case 32 comprises two accommodating parts 33, 33 formed in a rectangular shape integrally connected with each other, and is a single integral unit. The replaceable razor blade 2 is accommodated in the accommodating part 33 so as to face down. An engagement projection 35 is formed on the inner surface of the end surface 34 of the accommodating part 33, and the lower end edge 36 of the sidewalls 15 of the base engages with the engagement projection 35, preventing the replaceable razor blade 2 from falling out. The lower end edge 36 of the sidewalls 15 also acts to engage a cap 37 of the replaceable razor blade shown in FIG. 11. As shown in FIG. 11, the cap 37 can be fitted on the replaceable razor blade 2. An engagement projection (not shown in the drawing) is formed on an inner surface of the end surface of the cap 37, and when the cap 37 is fitted on the replaceable razor blade 2, the engagement projection engages with the lower end edge 36 of the sidewalls 15.

A lid 38 is provided on the respective accommodating parts 33 of the case 32. The lid 38 is integrally connected with the walls of the accommodating parts 33 by a hinge 39, and opens/closes by rotation centering on the hinge 39. An engaging part 40 is provided on the lower edge opposite the hinge 39 of the lid 38, and when the lid 38 is closed, the engaging part 40 engages with the engaging part provided on the outside of the wall of the accommodating parts 33.

EXPLANATION OF THE LEGENDS

1 Handle
2 Replaceable razor blade
3 Razor blade unit
4 Skin contact member
5 Base
6 Razor blade cartridge
7 Body
8 Base lateral surfaces
9 Engagement projections
10 Edge surface
11 Engagement projection
12 Cutting edge
13 Cutting edge
14 Cutting edge
15 Sidewalls
16 Elastic piece
17 Connecting piece
18 Leading skin contact part
19 Grooves
20 Trailing skin contact part
21 Skin contact surface
22 Windows
23 Disk-like rollers
24 Holes
25 Roller
26 Connector
27 Bearing
28 Connecting body
29 Roller
30 Shaft
31 Comb blades
32 Case
33 Accommodating parts
34 End surface
35 Engagement projection
36 Lower end edge
37 Cap
38 Lid
39 Hinge
40 Engaging part
41 Common tangent
42 Journal shaft
43 Engagement projection

The invention claimed is:

1. A safety razor comprising a handle;

a razor blade unit mounted on the handle; and a skin contact member movable with respect to the razor blade unit, wherein the razor blade unit has a razor blade body extending in a longitudinal direction of the razor blade unit;

the skin contact member comprises a leading skin contact part extending in front of and parallel to the razor blade body, a trailing skin contact part extending in back of and parallel to the razor blade body, the skin contact member is mounted on the handle or razor blade unit so that, during safety razor use, the leading skin contact part can swing in front of and with respect to the razor blade body and the trailing skin contact part can swing in back of and with respect to the razor blade body;

the leading skin contact part and the tailing skin contact part are integrally connected with each other by one or more connectors;

the leading skin contact part and trailing skin contact part integrally swing along a swing axis line that crosses through or near a connector center, and the entire skin contact member swings in a seesaw manner centered on the swing axis line;

at least one window is provided on at least one of the surfaces of the leading skin contact part and trailing skin contact part; and a portion of a rotating body mounted inside the skin contact part is exposed from at least one window and rotates relative to the surface of the skin contact part.

2. A safety razor comprising a handle;

a razor blade unit mounted on the handle; and a skin contact member movable with respect to the razor blade unit, wherein the razor blade unit has a razor blade body extending in a longitudinal direction of the razor blade unit;

the skin contact member comprises a leading skin contact part extending in front of and parallel to the razor blade body, a trailing skin contact part extending in back of and parallel to the razor blade body and one or more connectors integrally connecting the leading skin contact part to the trailing skin contact part;

the skin contact member is mounted on the handle or razor blade unit so that, during safety razor use, the leading skin contact part can swing in front of and with respect to the razor blade body and the trailing skin contact part can swing in back of and with respect to the razor blade body;

the skin contact member laterally surrounds the razor blade unit;

a swing axis line crosses through or near a connector center, and the entire skin contact member swings in a seesaw manner centered on the swing axis line;

at least one window is provided on at least one of the surfaces of the leading skin contact part and trailing skin contact part; and a portion of a rotating body mounted inside the skin contact part is exposed from at least one window and rotates relative to the surface of the skin contact part.

3. A safety razor according to claims 1 or 2, wherein there are provided a plurality of windows; and the rotating bodies exposed respectively from the windows are integrally connected with one another by a single shaft so as to integrally rotate.

4. A safety razor comprising a handle;

a razor blade unit mounted on the handle; and a skin contact member movable with respect to the razor blade unit, wherein the razor blade unit has a razor blade body extending in a longitudinal direction of the razor blade unit;

the skin contact member comprises a leading skin contact part extending in front of and parallel to the razor blade body, a trailing skin contact part extending in back of and parallel to the razor blade body, the skin contact member is mounted on the handle or razor blade unit so that, during safety razor use, the leading skin contact part can swing in front of and with respect to the razor blade body and the trailing skin contact part can swing in back of and with respect to the razor blade body;

the leading skin contact part and the trailing skin contact part are integrally connected with each other by one or more connectors;

the leading skin contact part and trailing skin contact part integrally swing along a swing axis line that crosses trough or near a connector center, and the entire skin contact member swings in a seesaw manner centered on the swing axis line;

at least one of the leading skin contact part and trailing skin contact part is a cylindrical roller and is rotatably connected to the skin contact member; and a roller surface constitutes a shaving aid comprising a Guttiferae extract from 0.05 to 10 wt. %.

5. A safety razor according to claim 1 or 2, wherein the trailing skin contact part is provided with three or more windows on a middle recessed portion between two raised end portions with one or more apertures;

a rotating body is exposed from each of the windows on the middle recessed portion;

the rotating bodies rotate independently from one another on one or more shafts; and the leading skin contact member surface is substantially comprised of a cylindrical roller rotatably connected to the skin contact member with a diameter of 7.5-10 mm.

* * * * *